US011049479B1

(12) United States Patent
Schanck

(10) Patent No.: US 11,049,479 B1
(45) Date of Patent: Jun. 29, 2021

(54) OFFSET GUITAR

(71) Applicant: William Arthur Schanck, Delmar, NY (US)

(72) Inventor: William Arthur Schanck, Delmar, NY (US)

( * ) Notice: Subject to any disclaimer, the term of this patent is extended or adjusted under 35 U.S.C. 154(b) by 137 days.

(21) Appl. No.: 16/602,838

(22) Filed: Dec. 11, 2019

(51) Int. Cl.

| | |
|---|---|
| ***G10D 3/02*** | (2006.01) |
| ***G10D 3/06*** | (2020.01) |
| ***G10D 1/08*** | (2006.01) |
| ***G10D 3/12*** | (2020.01) |
| ***G10D 3/04*** | (2020.01) |

(52) U.S. Cl.
CPC ..... *G10D 3/02* (2013.01); *G10D 1/08* (2013.01); *G10D 3/04* (2013.01); *G10D 3/06* (2013.01); *G10D 3/12* (2013.01)

(58) Field of Classification Search
CPC ..... G10D 3/02; G10D 1/08
See application file for complete search history.

(56) References Cited

U.S. PATENT DOCUMENTS

| | | | | | |
|---|---|---|---|---|---|
| 536,634 | A * | 4/1895 | Kyle | G10D 1/08 | 84/263 |
| 542,788 | A * | 7/1895 | Almcrantz | G10D 1/08 | 84/263 |
| 1,618,626 | A * | 2/1927 | Altpeter | G10D 1/08 | 84/263 |
| 4,056,034 | A * | 11/1977 | Kaman | G10D 1/08 | 84/267 |
| 4,178,827 | A * | 12/1979 | Mallory | G10H 3/185 | 84/291 |
| 4,429,608 | A * | 2/1984 | Kaman | G10D 3/22 | 84/291 |
| 5,469,770 | A * | 11/1995 | Taylor | G10D 3/02 | 84/291 |
| 5,814,744 | A * | 9/1998 | Hoke, Jr. | G10D 3/02 | 84/267 |
| 7,164,072 | B2 * | 1/2007 | Park | G10D 3/02 | 84/294 |
| 7,439,427 | B2 * | 10/2008 | Kroeger | G10D 3/02 | 84/173 |
| 8,378,191 | B2 * | 2/2013 | Barillaro | G10D 3/02 | 84/267 |
| 8,450,587 | B2 * | 5/2013 | McPherson | G10D 3/02 | 84/291 |
| 9,000,282 | B1 * | 4/2015 | Booth | G10D 1/08 | 84/291 |
| 9,171,528 | B2 * | 10/2015 | Seal | G10D 3/04 | |
| 2017/0206866 | A1 * | 7/2017 | Xavier | G10D 3/04 | |

* cited by examiner

*Primary Examiner* — Robert W Horn

(57) ABSTRACT

An acoustic guitar top includes a sound hole or holes, a neck end that is configured for attachment to a guitar neck with a longitudinal axis, a heel end, a transverse axis normal to the longitudinal axis, a bridge structure for attaching strings to the guitar body, and a bottom surface comprising a bridge plate. The locations of the neck attachment, and the bridge are translated away from the geographic centerline of the guitar toward the treble side of the instrument. The bottom surface of the guitar top includes finger braces of varying length to transmit vibrations from specific areas on the bridge plate of the guitar to specific areas of the guitar top.

2 Claims, 10 Drawing Sheets

OFFSET GUITAR

BACKGROUND OF THE INVENTION

Field of the Invention

Embodiments of the present invention generally relate to a flat top guitar (steel string) or to a classical (nylon string) guitar. More particularly, the invention relates to an improved configuration of the guitar body and top, and an improved method of transmitting vibrations from the bridge area of the guitar top to specific vibrating areas of the guitar top, thereby increasing the efficiency of music sound production.

Description of the Related Prior Art

The bracing structures applied to the bottom surface of guitar tops generally are either "X-bracing" with tone bars for a flat top guitar, or a variation of "fan-bracing" for a classical guitar. Regardless of the type of guitar or the bracing used, the neck attachment and bridge are generally located with their transverse mid-points lying on the longitudinal centerline of the guitar, said centerline generally coinciding with the geographic centerline of the guitar body and neck. This configuration means that half of the strings (on a guitar with an even number of strings) are thus located to the left of the longitudinal or geographic centerline, and the remaining half are thus located to the right of the longitudinal or geographic centerline.

The general configuration of a guitar body and top, when viewed with the guitar top facing the viewer and with the neck end pointing up, comprises: an upper convex rounded shape, the "upper bout"; below that a small area of convex shape, the "waist"; at the bottom a larger convex rounded shape, the "lower bout". The upper bout is generally heavily braced to react to the stresses imposed by the tension of the guitar strings operating on the guitar neck and neck attachment. Due to the stiffness of the upper bout, its contribution to the overall sound production of the guitar is minor.

The lower bout is excited by plucking strings anchored to the bridge, and is the major contributor to sound production. The symmetrical arrangement of the bridge and therefore the strings along the longitudinal and geographic centerline, being generally an aesthetic consideration, compromises the vibration transfer from bridge to guitar top.

It has been observed that when a guitar top is tapped at the geographic center of the lower bout, it resonates with a low frequency or sound, and that as the strikes are moved closer to the outer rim of the guitar top, the resonant frequencies or sounds increase. Similar observations have been made about percussion drum heads.

SUMMARY OF THE INVENTION

The invention capitalizes on these resonant properties by: 1). Translating the mid points of the neck attachment and the bridge to be to the right, toward the treble side of the guitar and away from the longitudinal/geographic centerline of the guitar. The amount of offset from the geographic centerline is nominally one inch on a six string guitar. This, therefore, locates the bass strings and their attachment points on the bridge closest to the centerline where the guitar top is most resonant for lower bass frequencies. The treble strings and their attachment points, therefore, are located closer to the outer rim of the lower bout, where the top is more resonant for higher frequencies.

2.) Installing finger braces on the lower surface of the guitar top, said braces being of varying length, with the shortest brace originating below the bridge attachment point of the lowest frequency string (E string) and terminating approximately at the geographic center of the lower bout. This finger brace thus delivers the vibrational energy of the plucked E string to the area of the soundboard that is most resonant for the lower frequencies. The length of the finger brace for the next lowest frequency string (the A string) is slightly longer than the brace for the E string, the brace for the A string originating below the attachment point for the A string and terminating at a point further away from the geographic centerline than does the brace for the E string. The installation of the remaining finger braces continues is a similar fashion: finger braces for the D, G, B and e—with "e" being the highest frequency—strings originate beneath the string attachment point of the bridge for the individual strings and terminate ever closer to the outer rim of the lower bout, thus delivering their vibrational energy to areas of the lower bout that are most resonant for those particular frequencies.

The presence of a traditional X-brace is meant only as a reinforcement of the guitar top to resist the stresses imposed by string tension and is incidental to the operation of the offset neck attachment, offset bridge, and finger bars. Likewise, the presence of a sound hole or holes is meant only to allow air to move freely into and out of the hollow guitar body, thus allowing the guitar top to vibrate essentially undamped, as is prior practice, it's location being incidental to the invention.

The guitar top applying this invention may be made from traditional materials, generally wood or wood composites, non-traditional materials such as plastic, fiberglas or carbon fiber composites, or hybridized materials such as laminations of various wood species and man-made materials such as fabric, plastic, fiberglas and carbon fiber.

BRIEF DESCRIPTION OF THE DRAWINGS

It is to be noted that the appended drawings illustrate only typical embodiments of this invention and are therefore not to be considered limiting its scope.

DETAILED DESCRIPTION

The present invention relates to the configuration of a flat top or classical guitar. More particularly, the invention relates to a novel configuration of the neck attachment and bridge, specifically the offsetting of these components away from the geographic centerline of the body and toward the treble side. Further, the invention relates to a novel configuration of finger braces attached to the underside of the guitar top, said braces efficiently capturing vibrational energy produced by the strings and delivering that energy from the bridge to specific resonant areas of the guitar top.

Figure 1:
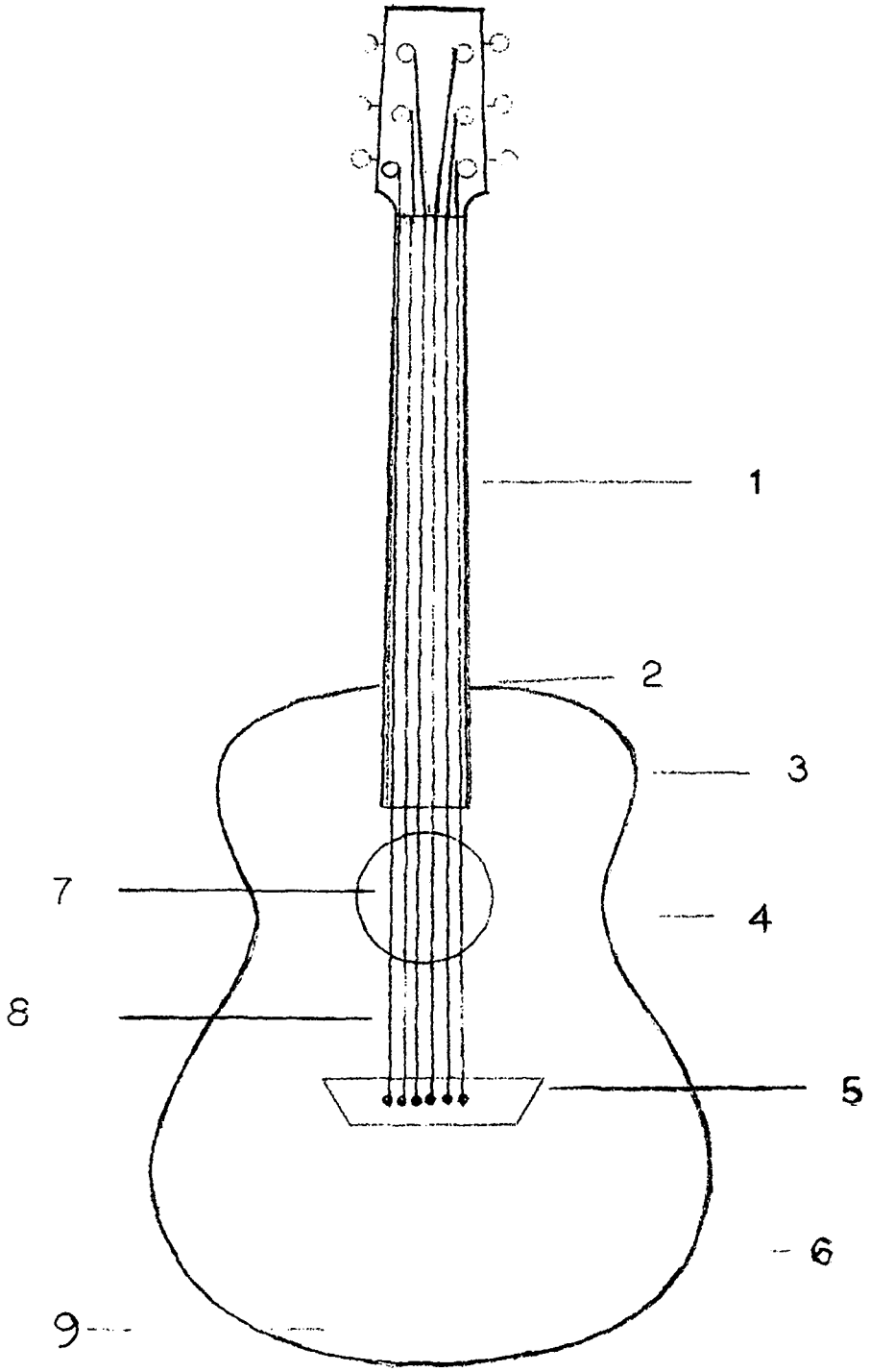
FIG. 1 is a view of a typical guitar of prior art, the guitar top facing the viewer and the neck end of the guitar pointing up. The various components are identified with industry standard nomenclature.

FIG. 1 is a plan view of the top surface of a typical prior art guitar, showing industry standard nomenclature of the components. The guitar is comprised of a neck 1, a neck attachment 2, an upper bout 3, a waist 4, a bridge 5, a lower bout 6, a sound hole 7, strings 8, and the heel 9.

Figure 2:
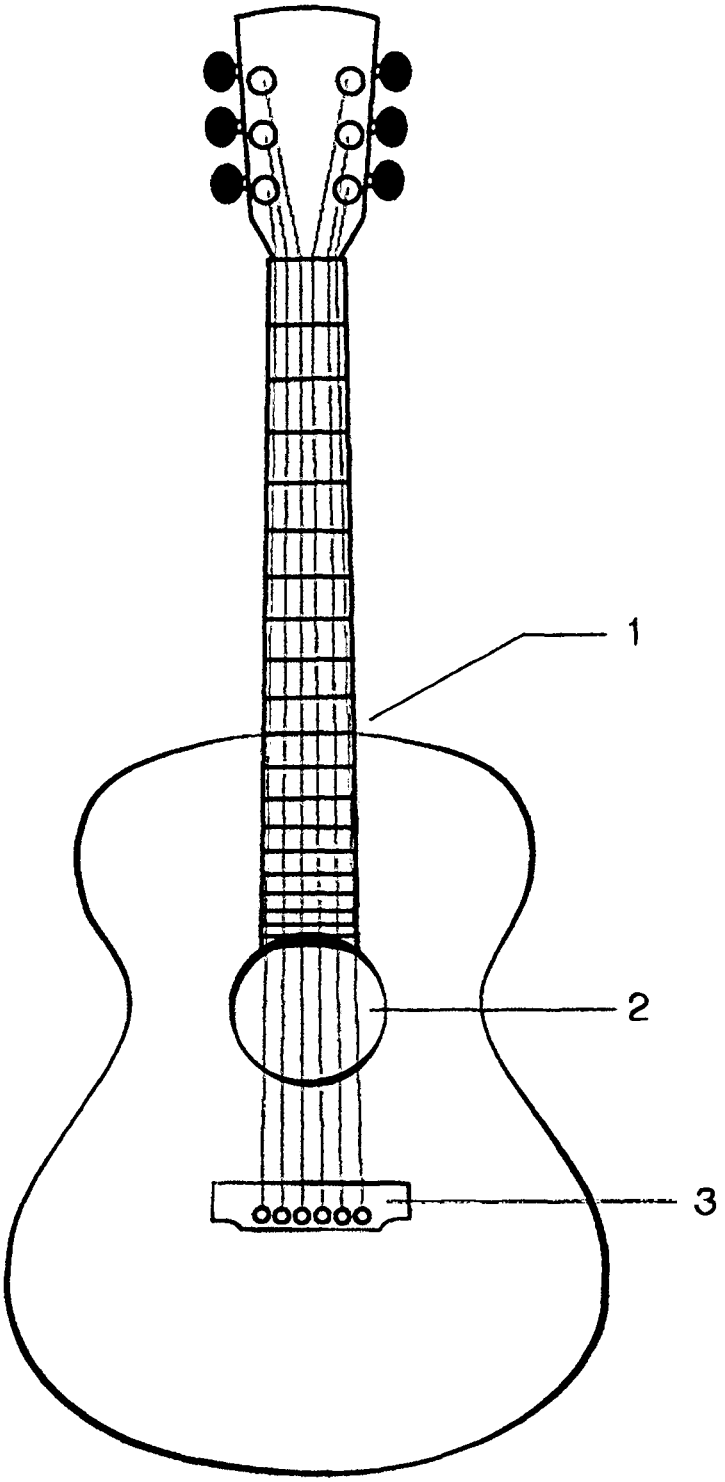
FIG. 2 is a view of a typical guitar reflecting prior art, in particular the symmetry of the guitar body lower bout, neck attachment, and bridge about the geographic centerline.

FIG. 2 is a plan view of the top surface of a typical prior art guitar, showing the symmetry of the neck attachment 1, the sound hole 2, and the bridge 3 about the geographic centerline of the guitar.

Figure 3:
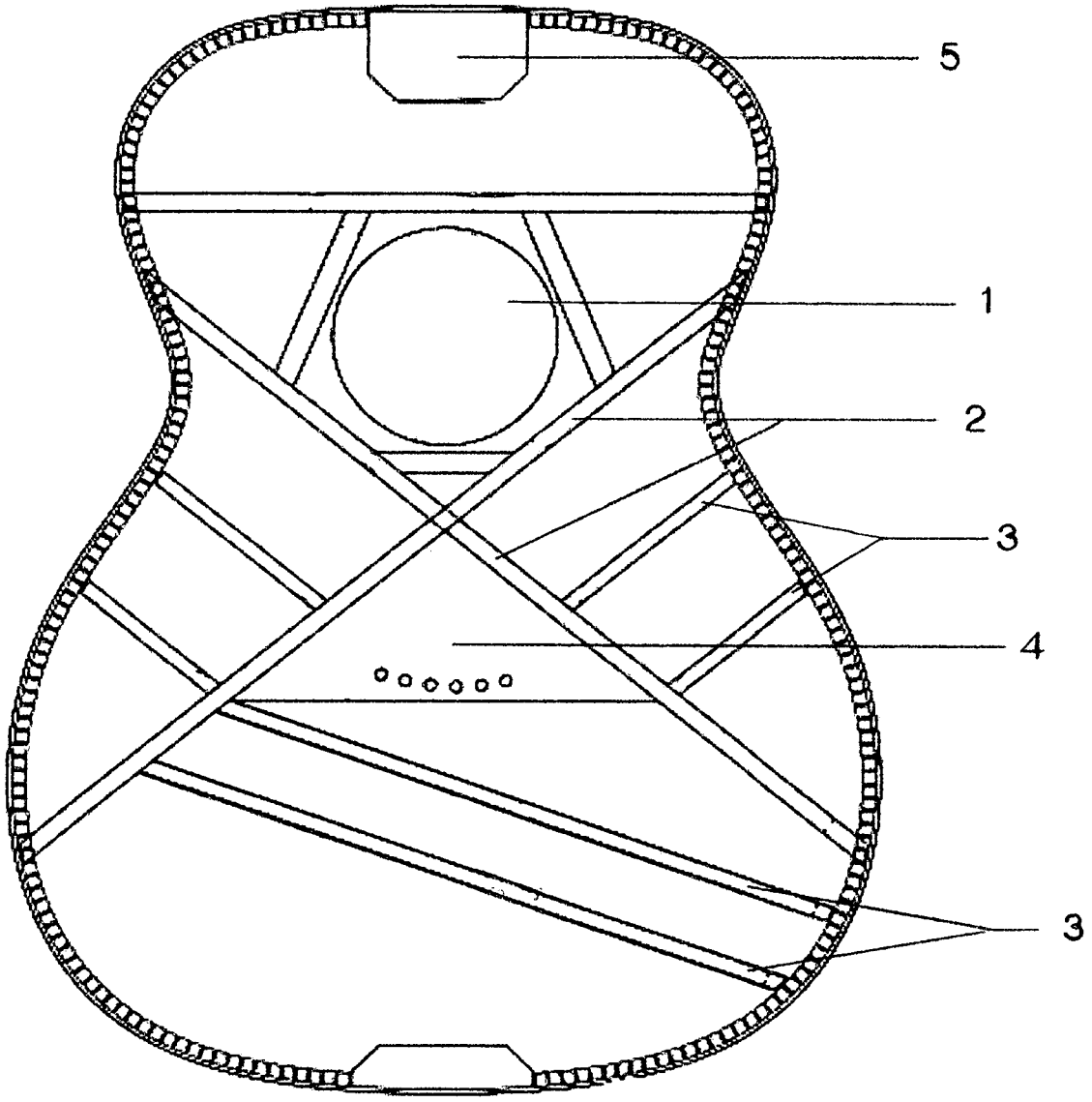
FIG. 3 is an interior view of the lower surface of a prior art guitar top, this figure representing the bracing and tone bar structure generally used on flattop (steel string) guitars.

FIG. 3 is an interior view of the underside of the guitar top for a prior art flattop guitar.

The X brace 2 reinforces the top to resist the tension of the strings. The tone bars 3 carry vibration to different areas of the top. The bridge plate 4 reinforces the top and is located below the bridge that is mounted to the upper surface of the guitar top. The neck attachment 5, bridge plate 4, and sound hole 1 are positioned symmetrically about the geographic centerline of the guitar. The position of the sound hole 1 may be anywhere on the guitar top or for that matter the guitar body, but is shown here as being on the centerline of the guitar top.

Figure 4:
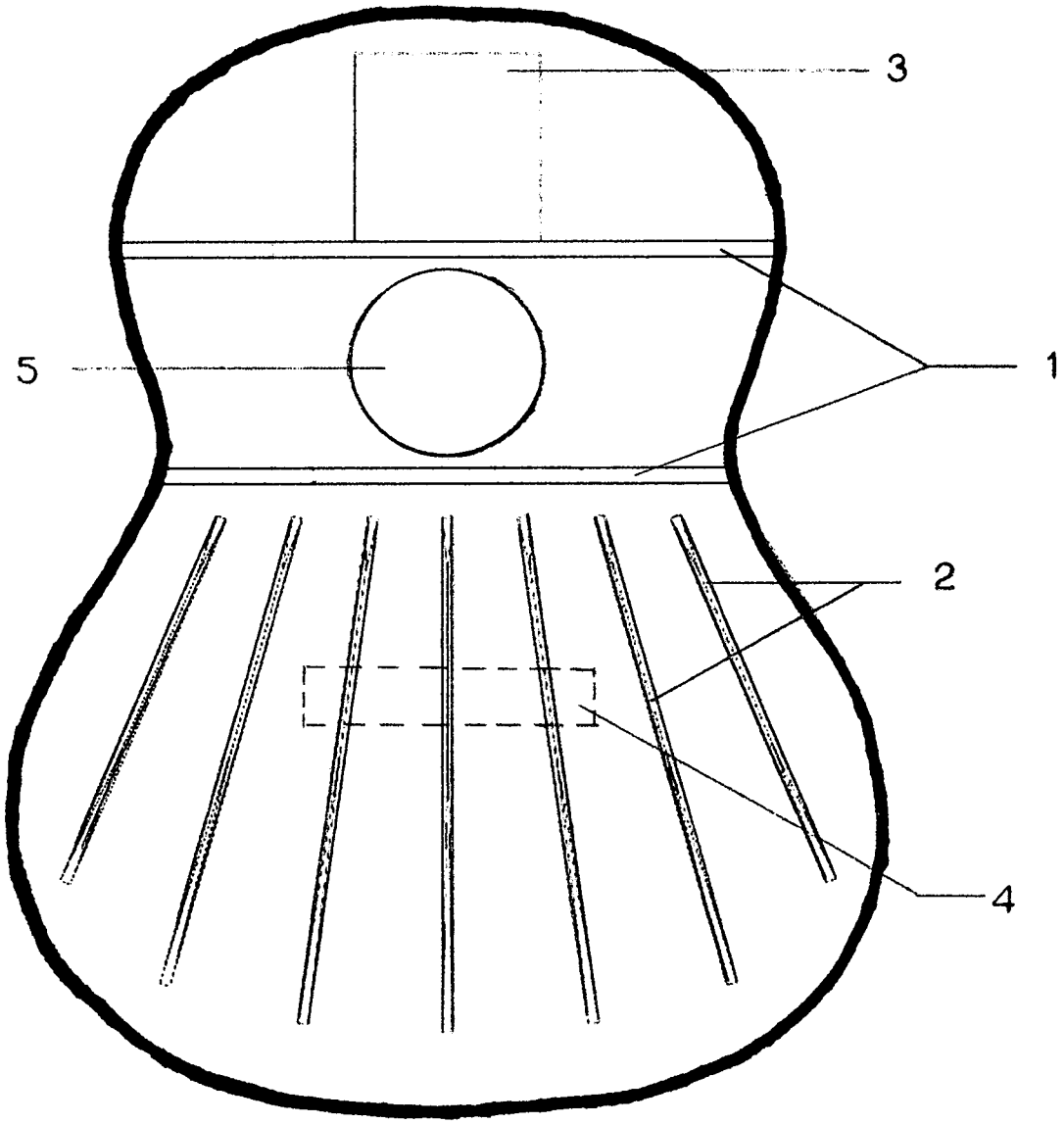
FIG. 4 is an interior view of the lower surface of a prior art guitar top, this figure representing the bracing and tone bar structure of a classical (nylon string) guitar.

FIG. 4 is an interior view of the underside of the guitar top for a prior art classical guitar. The lateral braces 1 reinforce the top. The brace and tone bars 2 function to both reinforce the guitar top and to carry vibration to different areas of the top. Classical guitars typically do not have bridge plates, so the bridge 4 mounted to the upper surface of the guitar top is shown in phantom view. The neck attachment 3, the bridge 4 and the sound hole 5 are positioned symmetrically about the geographic centerline of the guitar.

Figure 5:
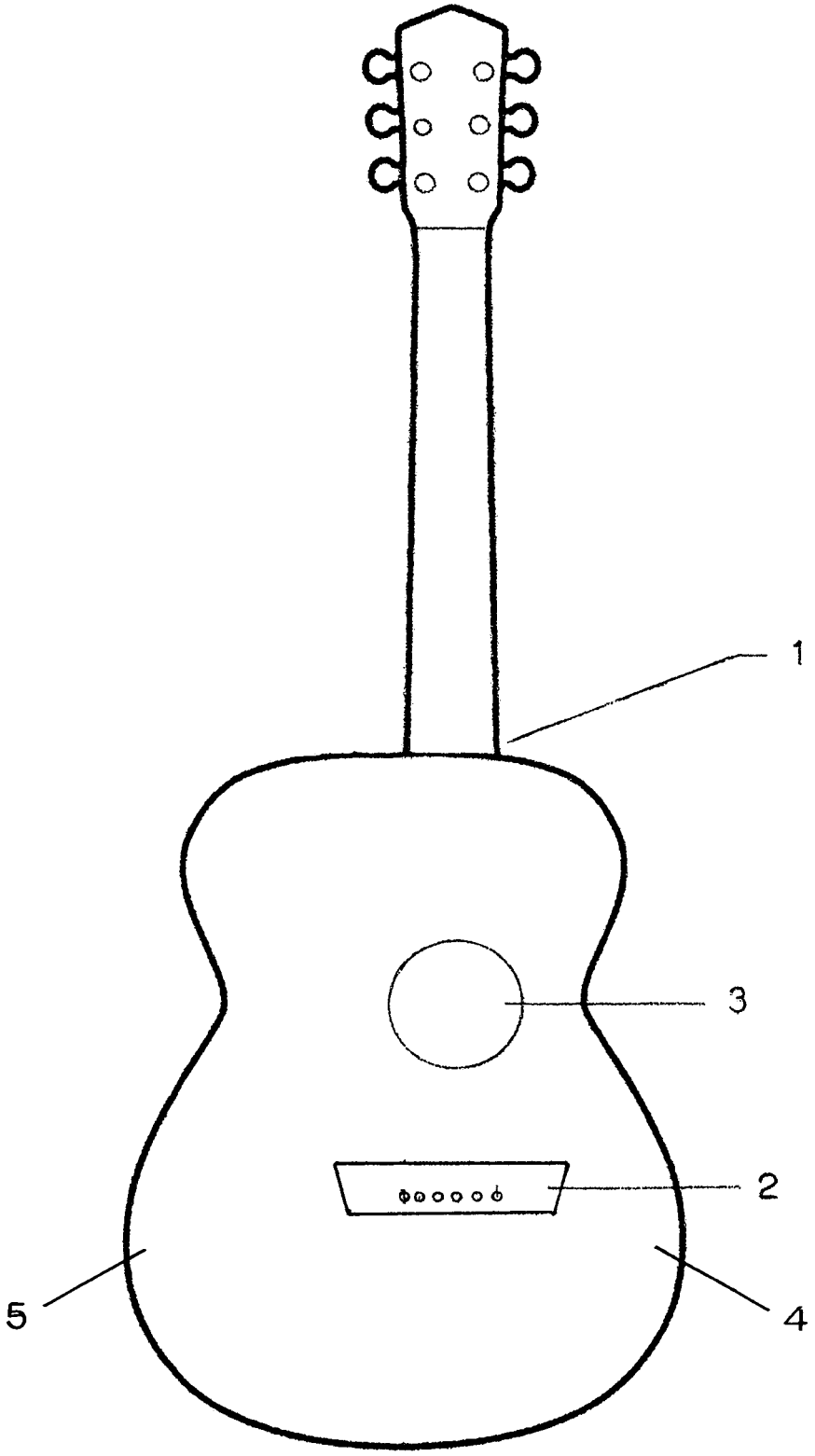
FIG. 5 is a view of a guitar, the guitar top facing the viewer and the neck end of the guitar pointing up, applying the present invention as to the offset of the neck attachment and of the offset of the bridge away from the geographic centerline and toward the treble side.

FIG. 5 shows a plan view of a guitar applying the present invention. The neck attachment 1, the bridge 2 and the sound hole 3 are offset nominally one inch to the right, toward the treble side 4 of the guitar and away from the bass side 5 of the guitar. The location of the sound hole 3 is incidental to the invention and is shown only to assist with orientation.

Figure 6:
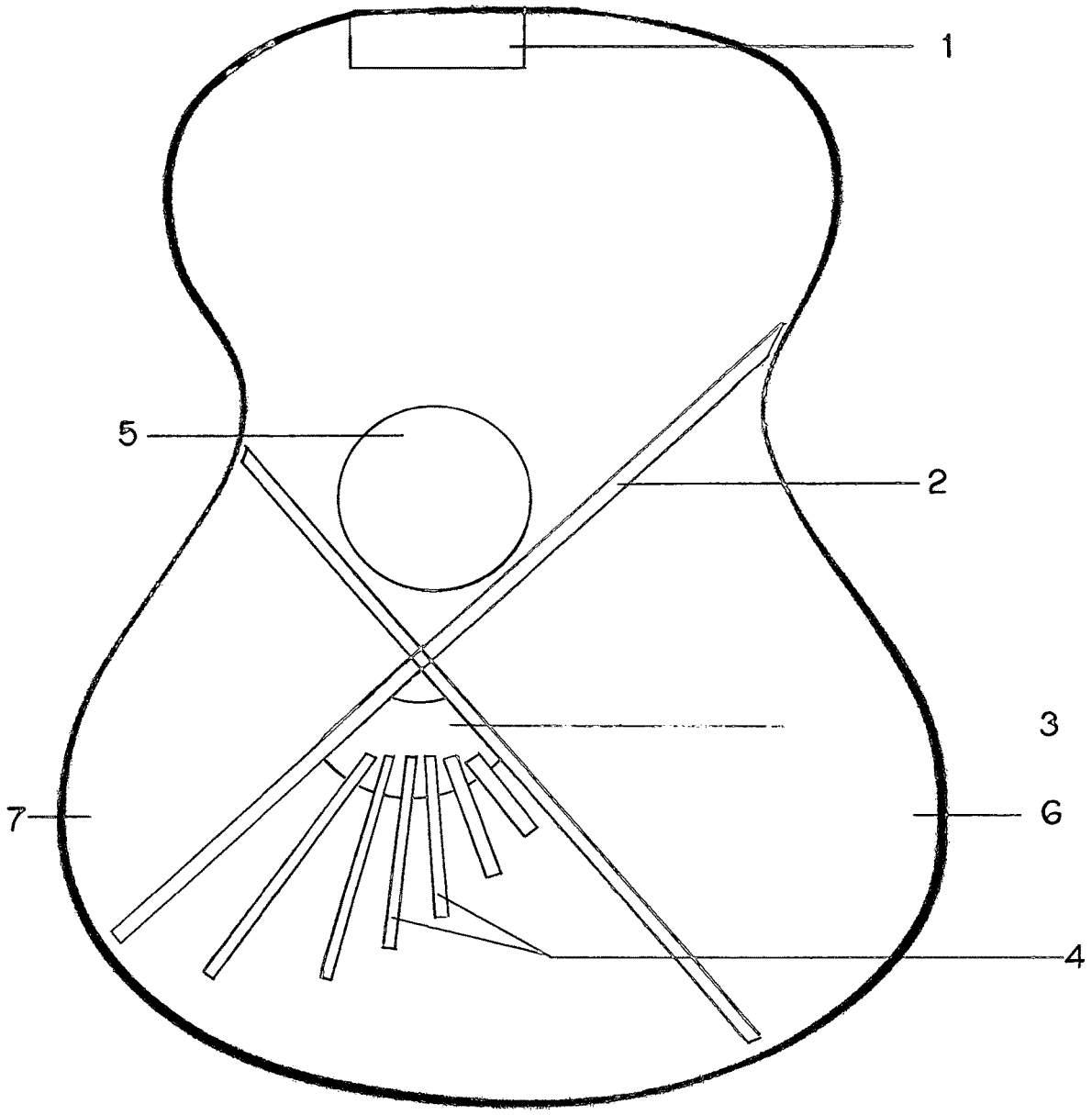
FIG. 6 is an interior view of a guitar top applying the present invention, including the offsetting of the neck attachment and bridge plate, and the positioning of finger braces that originate at the bridge plate and terminate at the appropriate resonant area of the guitar top.

FIG. 6 is an underside view of the guitar top, applying the current invention. The neck attachment 1, sound hole 5, the X brace 2 and the bridge plate 3 are offset away from the bass side of the guitar 6 and toward the treble side of the guitar 7. The bridge plate 3 is located on the underside, in the same location as the bridge and string attachment that are mounted to the upper surface. The location of the sound hole 5 is incidental to the invention and is shown only to assist with orientation.

Figure 7:
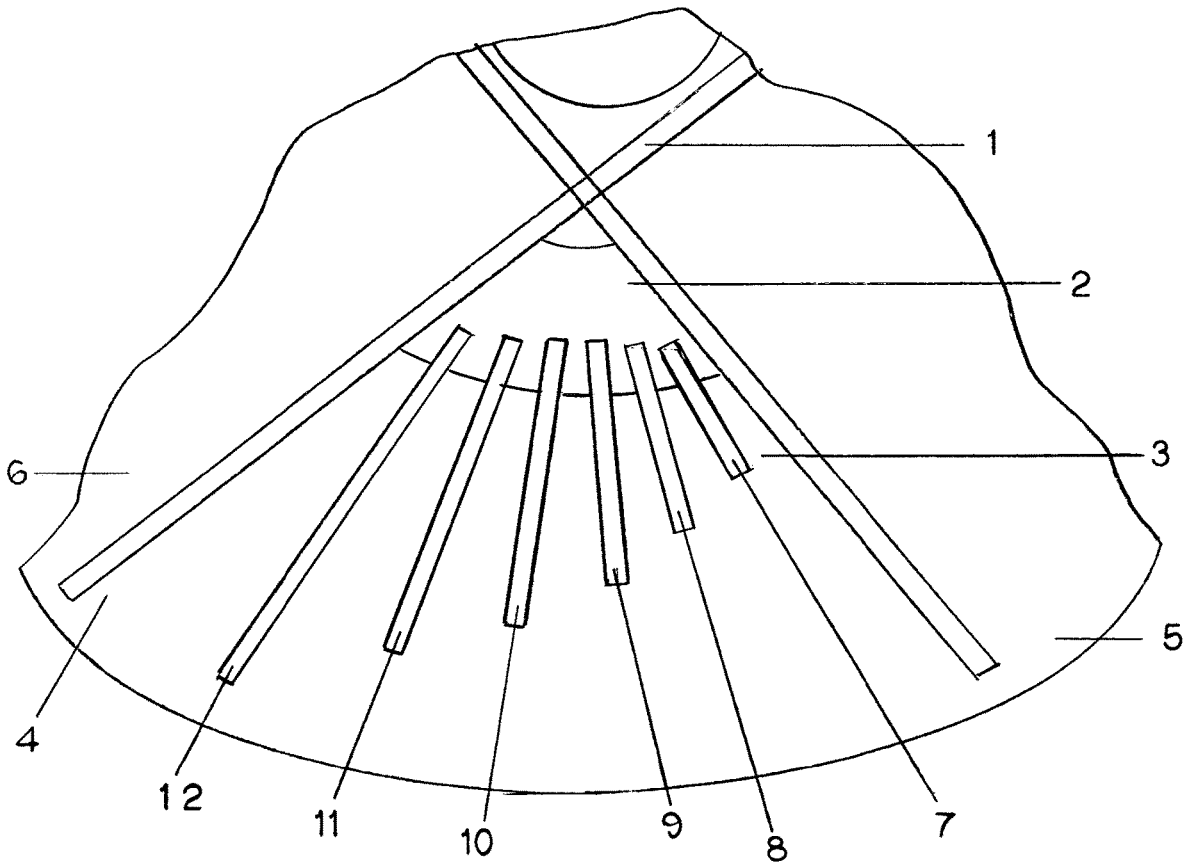
FIG. 7 is an enlarged partial view of the underside of the guitar top, specifically in the lower bout/heel area. The origination of the finger braces at the bridge plate and the termination of the finger braces in specific resonant areas of the guitar top are shown.

FIG. 7 is a partial enlarged view of the interior of the guitar top in the area of the lower bout and heel. The right side of the guitar is the bass side 5 and the left side is the treble side 6. The X-brace 1, mentioned previously, reinforces the guitar top. The bridge plate 2 is located on the underside, in the same area as the bridge and string attachment that is mounted to the upper surface. The location of the sound hole 13 is incidental to the invention and is shown only to assist with orientation. Each finger brace 7, 8, 9, 10, 11, 12 originates at the bridge plate, at a point approximately coincident with the corresponding string attachment point on the upper surface. Specifically, the finger brace 7 originates at a point that is below the attachment point for the 6th or "E" string—the lowest frequency string—on the upper surface of the guitar top. The finger brace 8 originates at a point that is below the attachment point for the 5th or "A" string. The origination points for the finger braces 9, 10, 11, 12 coincide with the string attachment points for the 4th ("D"), 3rd ("G"), 2nd ("B"), and 1st ("e"), respectively. The termination point for the finger brace 7 is closest to an area of the guitar top with lowest frequency resonance 3. The finger brace 8 is longer than brace 7 and its termination point on the guitar top is closer to the outer rim of the guitar, this termination point having a higher resonant frequency. The braces 9, 10, 11 and 12 increase successively in length, and their termination points on the guitar top move successively closer to the rim of the guitar, and the resonant frequencies of the guitar top successively increase as well. The termination point for the finger brace 12 (the "e" string), therefor, is closest to an area on the guitar top of highest frequency response 4.

Figure 8:
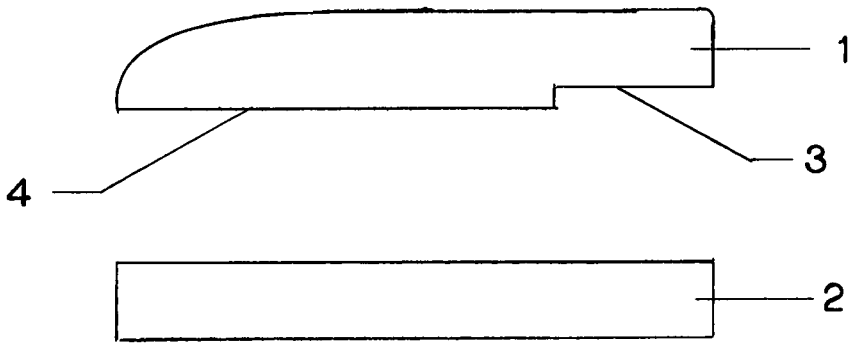
FIG. 8 includes views of a representative finger brace made from one material.

FIG. 8 shows a side view 1 of a representative finger brace made from solid one-piece material. The surface 3 is glued to the bridge plate mounted to the underside of the guitar top. The surface 4 is glued to the underside of the guitar top. The top view 2 of the brace shows the shape of the brace to be generally rectangular, and the ends of the brace to be squared, but they may be rounded or tapered.

Figure 9:
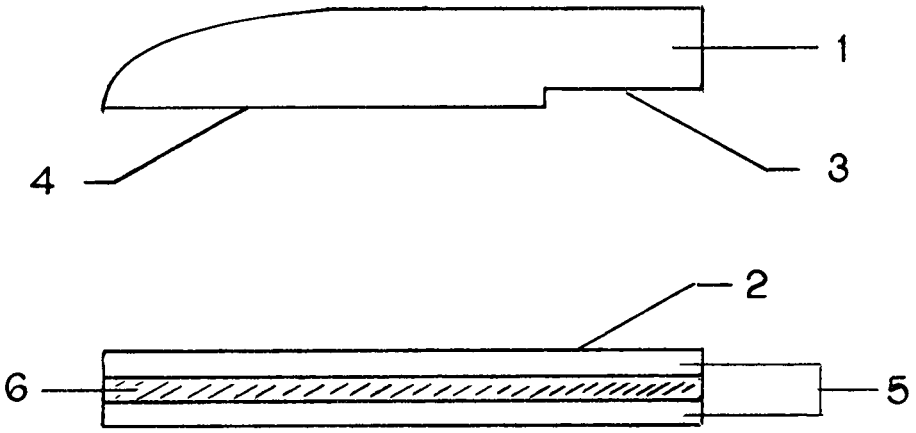
FIG. 9 includes views of a representative finger brace made from more than one material.

FIG. 9 shows a side view 1 and a top view 2 of a representative finger brace made from dissimilar layers of material such as: wood, plastics, fiberglas, carbon fiber composites or other. One example would be to use spruce wood for the outer layers 5 and rosewood for the inner layer 6. The surface 3 is glued to the bridge plate mounted to the underside of the guitar top. The surface 4 is glued to the underside of the guitar top. The top view 2 of the brace shows the shape of the brace to be generally rectangular, and the ends of the brace to be squared, but it may be rounded or tapered. There are three layers shown, but in practice the number of layers may be any practical number greater than two.

Figure 10:
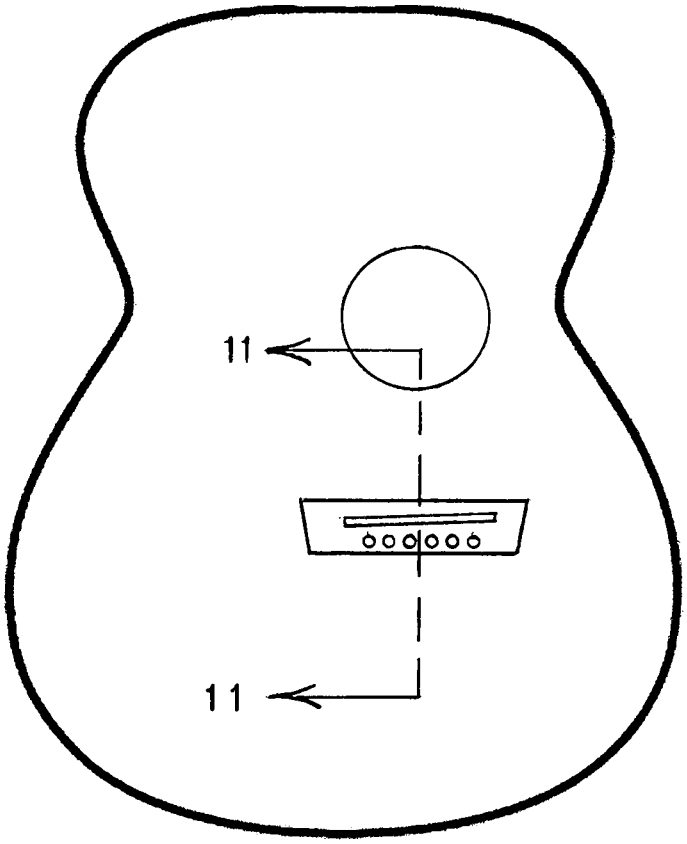
FIG. 10 shows the sectional view that is drawn in FIG. 11.

FIG. 10 shows a guitar body embodying the invention, with a sectional view "11" indicated.

Figure 11:
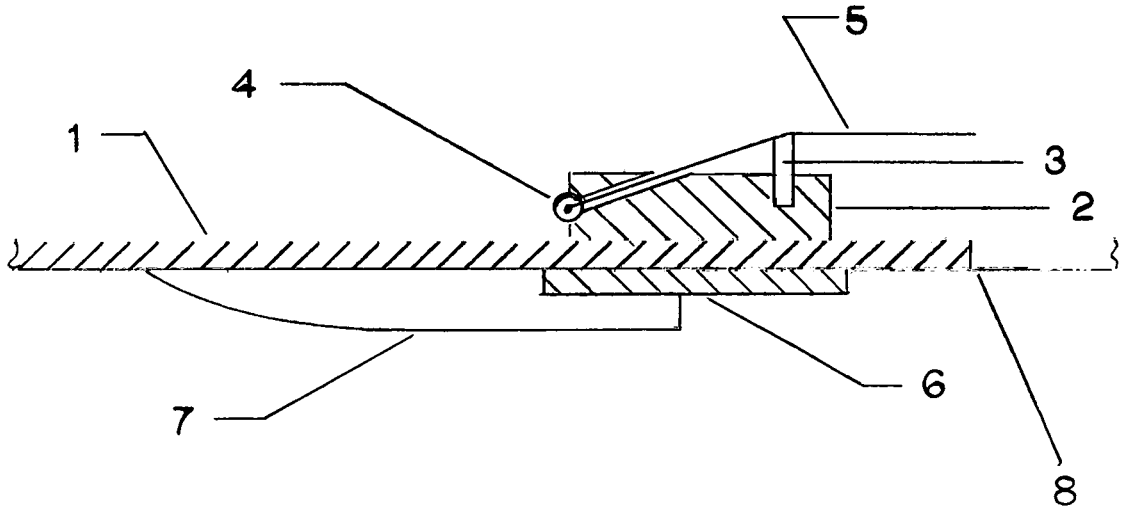
FIG. 11 is a sectional view through the guitar top and components.

FIG. 11 is a sectional view through the guitar top. The bridge 2 is attached to the outer surface of the guitar top 1 by glue or mechanical means, and has a saddle 3, on which the tensioned string 5 rests. The string attachment point 4 is part of the bridge 2 as well. The bridge plate 6 is normally glued to the underside of the guitar top 1. The finger brace 7 is glued to the bridge plate 6 and the guitar top 1. The edge of the sound hole 8 is shown only for orientation.

The invention claimed is:

1. An acoustic guitar comprising, a hollow body and a soundboard with a sound hole, and a neck and bridge saddle aligned parallel to the body length into a center line and strings situated on the face of the neck and bridge with bass strings to the left and treble strings to the right, wherein the center line of the neck and bridge saddle are translated away from the geographic center line of the hollow body and soundboard toward the treble side of the sound board, this configuration placing the bass string range side of the bridge saddle at or near the geographic center line of the soundboard, and placing the treble string range side to be neared to the outer edge of the soundboard, said placing improving the efficiency of sound production.

2. An acoustic guitar comprising: a hollow body, a sound board having inner and outer sides, and bracing inside the sound board, including braces arranged like radiating fingers, wherein the finger braces installed to the inner surface of the soundboard are arranged so that there is one finger brace per string, each finger brace originating at or near the area where its string contacts the bridge saddle, radiating from that point toward the edge of the soundboard, each finger brace terminating in an area of the soundboard that will best utilize the range of frequencies carried by the finger braces, specifically that the bass side finger braces will terminate close to the geographic center of the soundboard and the treble side finger braces will terminate closer to the edge of the soundboard, said arrangement improving the efficiency of sound production.

* * * * *